US005829558A

United States Patent [19]

Cheng

[11] Patent Number: 5,829,558

[45] Date of Patent: Nov. 3, 1998

[54] LUGGAGE TROLLEY WITH A DETACHABLE TUBE ASSEMBLY

[76] Inventor: Shih-Min Cheng, No. 1-2 Lane 132, Lin-Jiang Road. Da-Jia Town, Taichung Hsien, Taiwan

[21] Appl. No.: 919,270

[22] Filed: Aug. 28, 1997

[51] Int. Cl.[6] ..... A45C 5/14; A45C 13/22; A45C 13/26

[52] U.S. Cl. ..... 190/116; 190/18 A; 190/39; 16/115

[58] Field of Search ..... 190/18 A, 39, 190/115, 116; 280/37; 16/115

[56] References Cited

U.S. PATENT DOCUMENTS

| | | | |
|---|---|---|---|
| 3,257,120 | 6/1966 | Browning | 190/18 A X |
| 3,275,336 | 9/1966 | Warner, Jr. | 190/115 X |
| 4,087,102 | 5/1978 | Sprague | 190/18 A X |
| 4,792,025 | 12/1988 | Thomas | 190/115 X |
| 5,024,455 | 6/1991 | Schrecongost | 190/18 A X |
| 5,116,289 | 5/1992 | Pond et al. | 190/18 A |
| 5,323,886 | 6/1994 | Chen | 190/18 A |
| 5,374,073 | 12/1994 | Hung-Hsin | 190/18 A X |
| 5,507,508 | 4/1996 | Liang | 190/18 A X |
| 5,524,737 | 6/1996 | Wang | 190/115 X |
| 5,664,652 | 9/1997 | Shamah | 190/115 X |

*Primary Examiner*—Sue A. Weaver
*Attorney, Agent, or Firm*—Rosenberg, Klein & Bilker

[57] ABSTRACT

A tube assembly for a luggage trolley includes a mounting seat fixedly mounted to a luggage and an inner tube/outer tube assembly detachably mounted to the mounting seat. The inner tube/outer tube assembly includes two outer tubes, two inner tubes respectively, telescopically received in the outer tubes and each having an upper end and a lower end, and an operative handle mounted to the upper ends of the inner tubes.

5 Claims, 7 Drawing Sheets

LUGGAGE TROLLEY WITH A DETACHABLE TUBE ASSEMBLY

BACKGROUND OF THE INVENTION

1. Field of the Invention

The present invention relates to a luggage trolley which has a tube assembly detachably mounted thereto.

2. Description of the Related Art

A typical luggage trolley is shown in FIG. 7 of the drawings and includes a tube assembly 51 which, in turn, includes a pair of outer tubes 53, a pair of inner tubes 52 respectively, telescopically received in the outer tubes 53, and an operative handle 54 attached to upper ends of the inner tubes 52. Two mounting seats 55 are respectively mounted around upper ends and lower ends of the outer tubes 53 and each includes two ears 57 which are fixedly mounted to a luggage 50 by rivets 56. Each mounting seat 55 further includes two through holes through which the inner tubes 52 extend, respectively. Nevertheless, the tube assembly 51 cannot be detached from the luggage 50 and thus occupies a considerable space. In addition, the user cannot replace the tube assembly with one having an outline that he/she likes. The present invention aims to overcome these difficulties and to provide a luggage trolley with a detachable luggage trolley.

SUMMARY OF THE INVENTION

A tube assembly for a luggage trolley in accordance with the present invention generally comprises a mounting seat means fixedly mounted to a luggage, and an inner tube/outer tube assembly detachably mounted to the mounting seat means. The inner tube/outer tube assembly includes two outer tubes, two inner tubes respectively, telescopically received in the outer tubes and each having an upper end and a lower end, and an operative handle mounted to the upper ends of the inner tubes.

The mounting seat means includes an upper mounting seat fixedly mounted to an upper portion of the luggage and a lower mounting seat fixedly mounted to a lower portion of the luggage. The upper mounting seat has two first holes through which the upper ends of the outer tubes extend, and the lower mounting seat has two second holes through which the lower ends of the outer tubes extend.

The inner tube/outer tube assembly further includes a positioning seat to the which upper ends of the outer tubes are fixedly mounted. The positioning seat includes a snapping fastener means extending downwardly therefrom, and the upper mounting seat includes a slot means defined therein for releasably engaging with the snapping fastener means.

In an embodiment of the invention, the slot means includes a block provided on the upper mounting seat and including an upper slot defined in an upper side thereof through which the snapping fastener means extends and a side slot defined in a lateral side thereof and communicated with the upper slot for releasably engaging with the snapping fastener means.

In an alternate embodiment of the invention, the upper mounting seat is hollow and the slot means includes a slot defined in an upper side of the upper mounting seat through which the snapping fastener means extends.

In a preferred embodiment of the invention, the lower end of each outer tube includes a first transverse hole defined in a periphery thereof, and a periphery defining each second hole of the lower mounting seat includes a second transverse hole defined therein. An elastic means is mounted in the lower end of each outer tube and including a protrusion extended through the first through hole and releasably received in the second transverse hole.

Other objects, advantages, and novel features of the invention will become more apparent from the following detailed description when taken in conjunction with the accompanying drawings.

DESCRIPTION OF THE PREFERRED EMBODIMENTS

Figure 1:
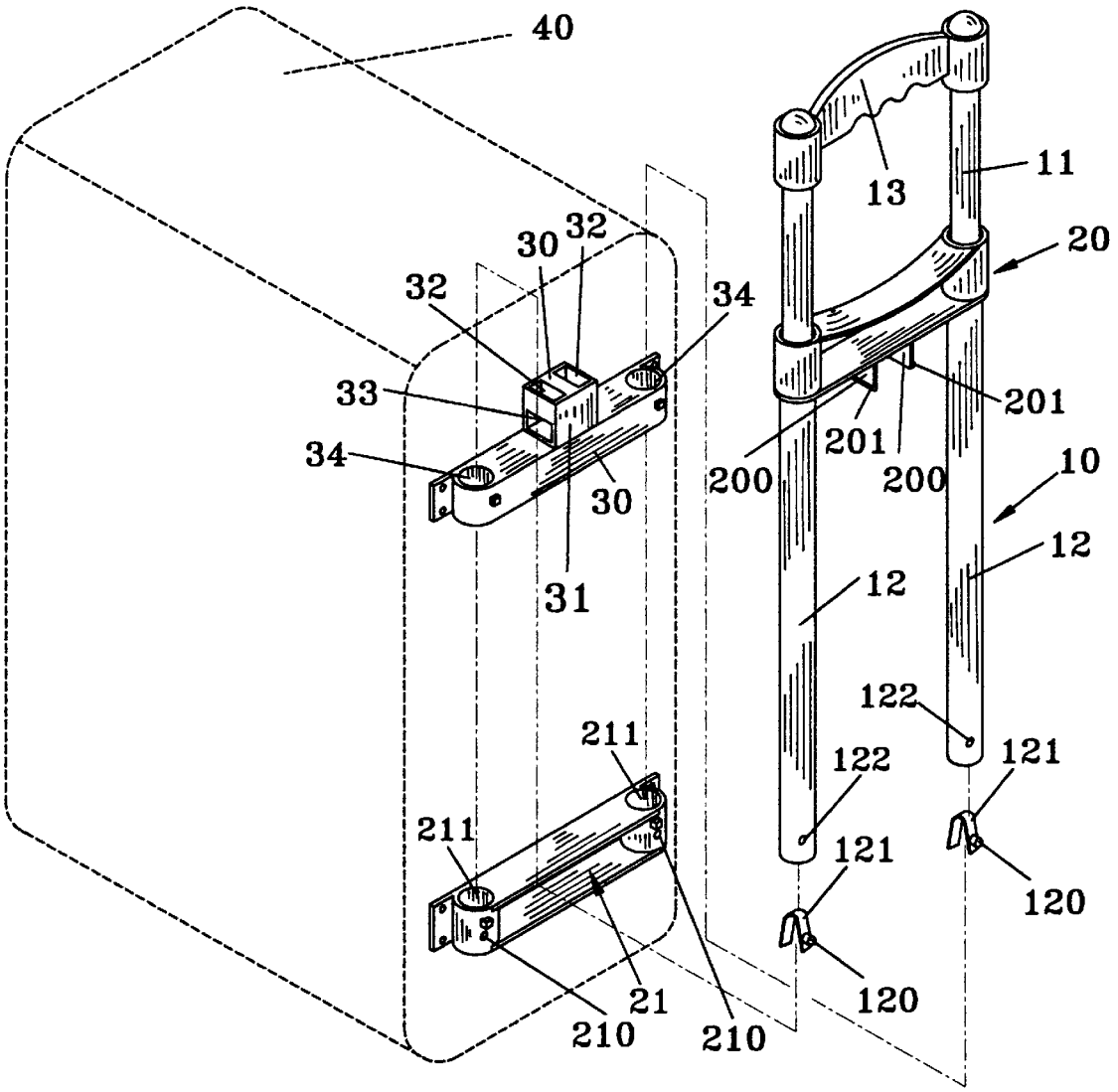
FIG. 1 is an exploded perspective view of a tube assembly for a luggage trolley in accordance with the present invention, in which the luggage is shown in phantom lines for clarity.
Figure 2:
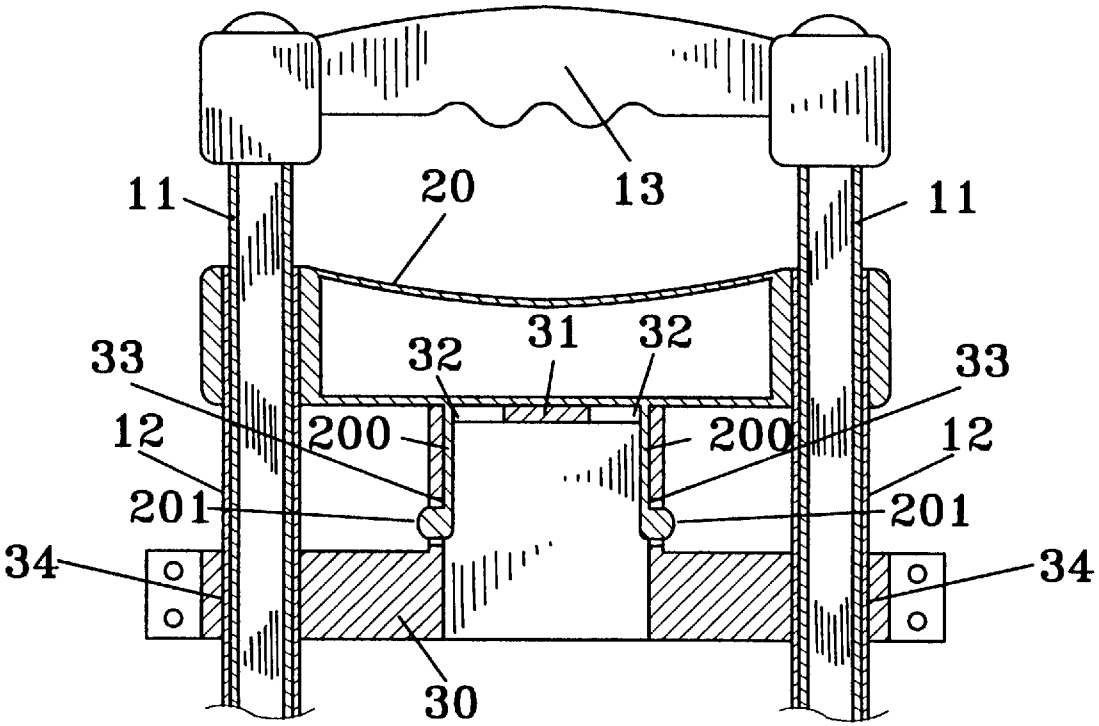
FIG. 2 is a partial cross sectional view illustrating an upper portion of the tube assembly.
Figure 3:
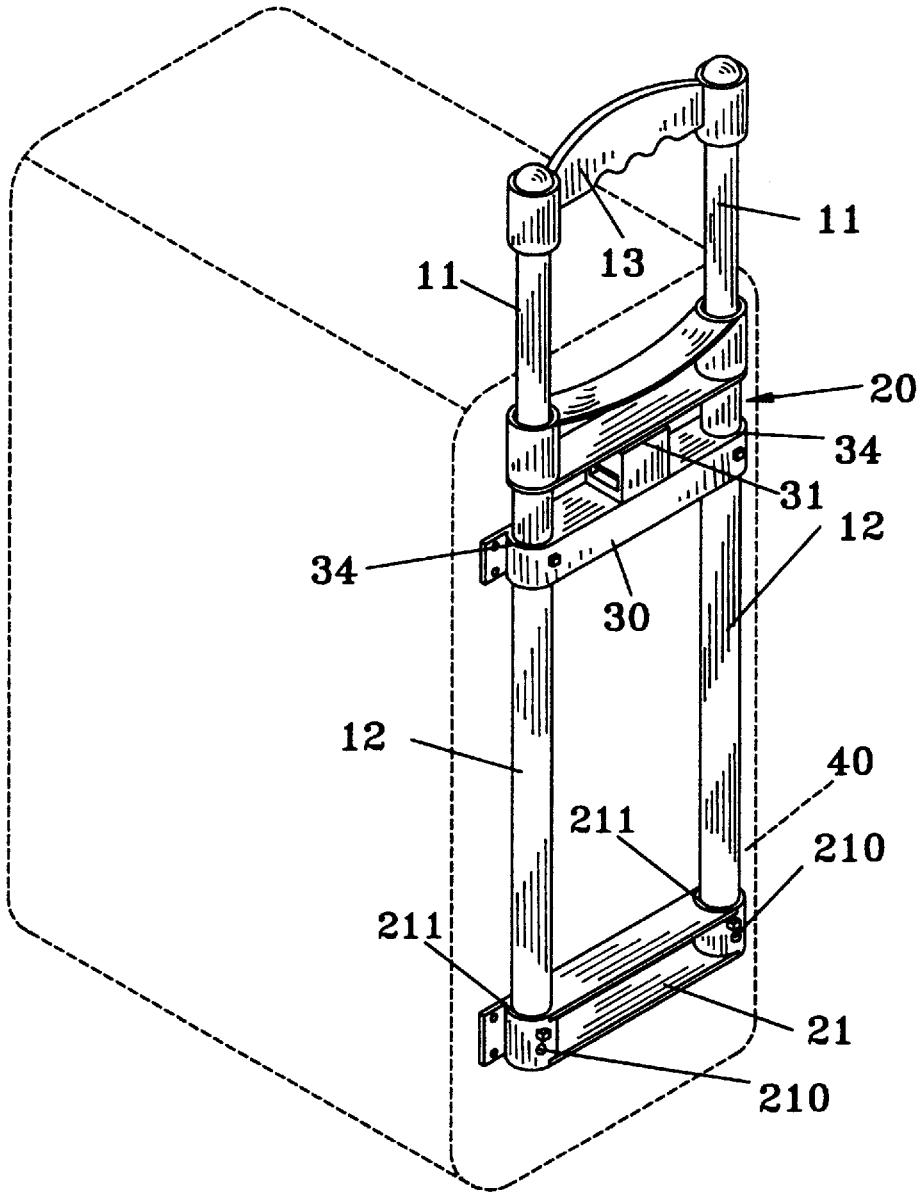
FIG. 3 is a perspective view of the tube assembly in accordance with the present invention.

Referring to FIGS. 1 to 6 and initially to FIGS. 1 to 3, a tube assembly for a luggage trolley in accordance with the present invention generally includes an upper mounting seat 30 fixedly mounted to an upper portion of a luggage 40, a lower mounting seat 21 fixedly mounted to a lower portion of the luggage 40, and an inner tube/outer tube assembly 10 detachably mounted to the lower and upper mounting seats 21 and 30.

The upper mounting seat 30 includes a pair of vertical holes 34 through which upper ends of the outer tubes 12 extend and a slot means defined therein. In this embodiment, the slot means includes a block 31 provided on an upper side of the upper mounting seat 30, and two upper slots 32 are defined in an upper side of the block 31 while two side slots 33 are respectively defined in two lateral sides of the upper mounting seat 30 and respectively communicated with the upper slots 32, the purpose of which will be described in detail later.

The lower mounting seat 21 includes a pair of vertical holes 211 in alignment with the vertical holes 34. In addition, a cylindrical member which defines the hole 211 includes a transverse hole 210 defined in a periphery thereof and communicated with the hole 211.

The inner tube/outer tube assembly 10 includes a positioning seat 20, a pair of outer tubes 12 having upper ends securely connected to the positioning seat 20, a pair of inner tubes 11 respectively, telescopically received in the outer tubes 12, and an operative handle 13 mounted to upper ends of the inner tubes 11. The positioning seat 20 includes two snapping fasteners 200 extending downwardly from a mediate section thereof, each snapping fastener 200 having a distal snapping end 201.

In assembly, the outer tubes 12 are extended through the holes 34 of the upper mounting seat 30 and the holes 211 of the lower mounting seat 21, and the snapping fasteners 200 are extended through the slots 32 until the snapping ends 201 respectively extended into the associated slots 33 and thus positioned, as shown in FIG. 2.

Figure 4:
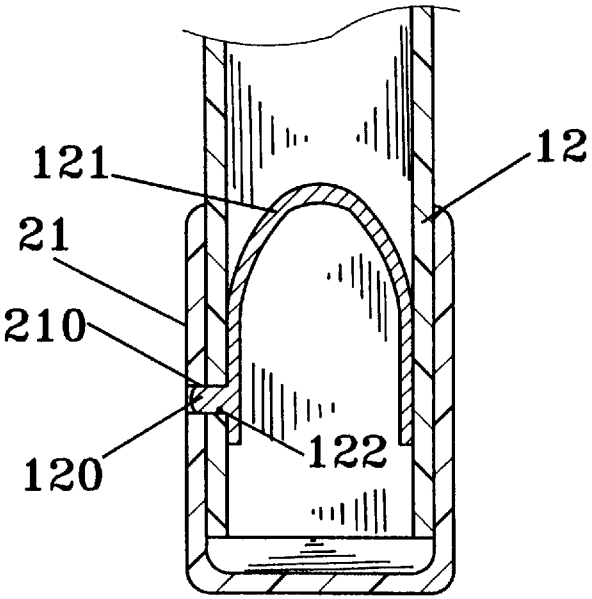
FIG. 4 is a partial sectional view illustrating engagement between a lower end of an outer tube and a lower end of an inner tube of the tube assembly.

In addition, referring to FIG. 4, a substantially U-shaped elastic member 121 is mounted in a lower end of each outer tube 12. The elastic member 121 includes a protrusion 120 which extends outwardly through a transverse hole 122 defined in the lower end of the outer tube 12 and then into the associated transverse hole 210 of the lower mounting seat 21.

When detaching the inner tube/outer tube assembly 10 from the mounting seats 30 and 21, the user may use one hand (e.g., the thumb and the index finger) to push the snapping ends 201 inwardly to disengage from the slots 33. Then, the user may use the other hand to push the protrusions 120 inwardly to disengage from the transverse holes 210 of the lower mounting seat 21. Thereafter, the user may pull the whole inner tube/outer tube assembly 10 upwardly to disengage from the upper and lower mounting seats 30 and 21. Thus, the inner tube/outer tube assembly 10 can be detached from the luggage 40 and placed into the luggage 40 when not in use and thus occupies a smaller space, and operation thereof is easy.

Figure 5:
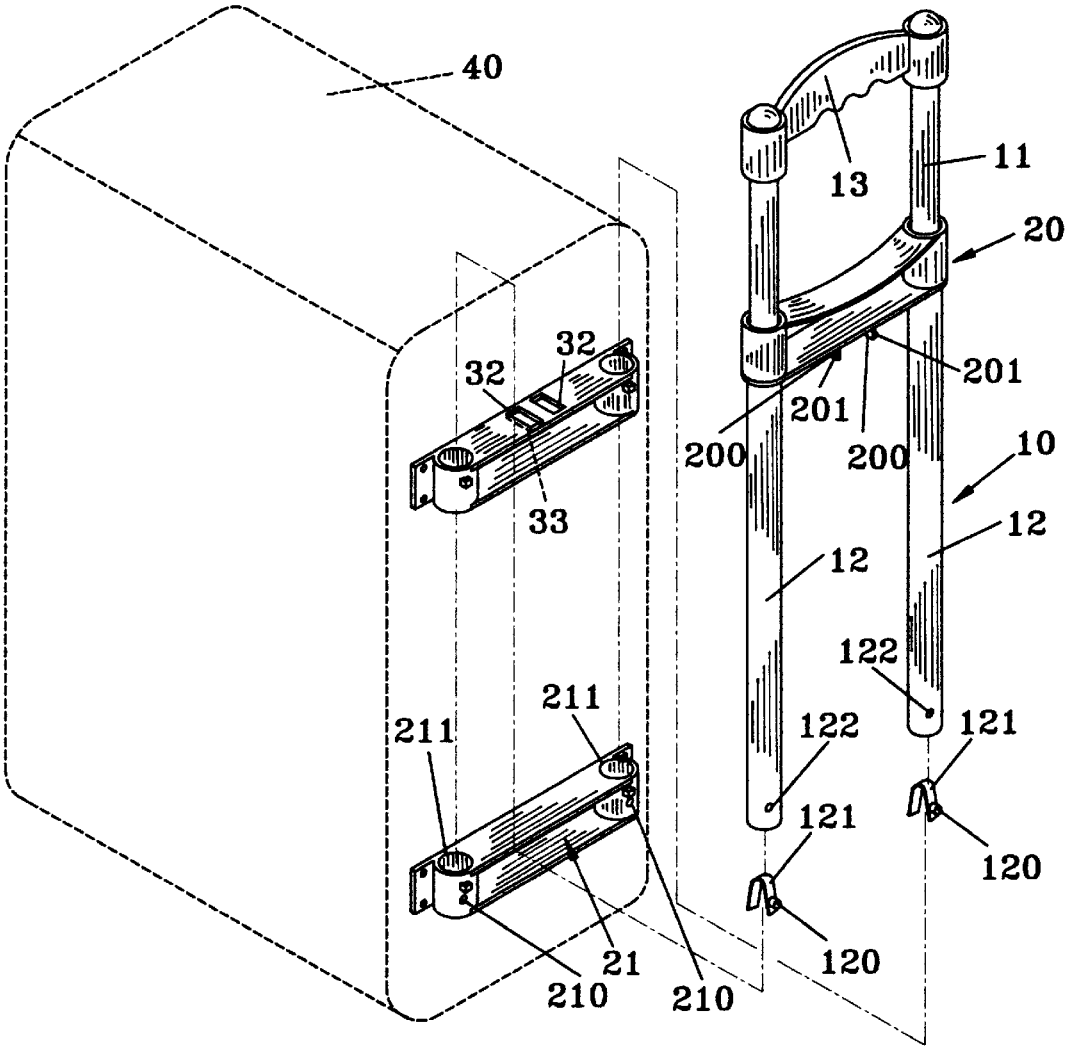
FIG. 5 is an exploded perspective view of a modified embodiment of the tube assembly in accordance with the present invention.
Figure 6:
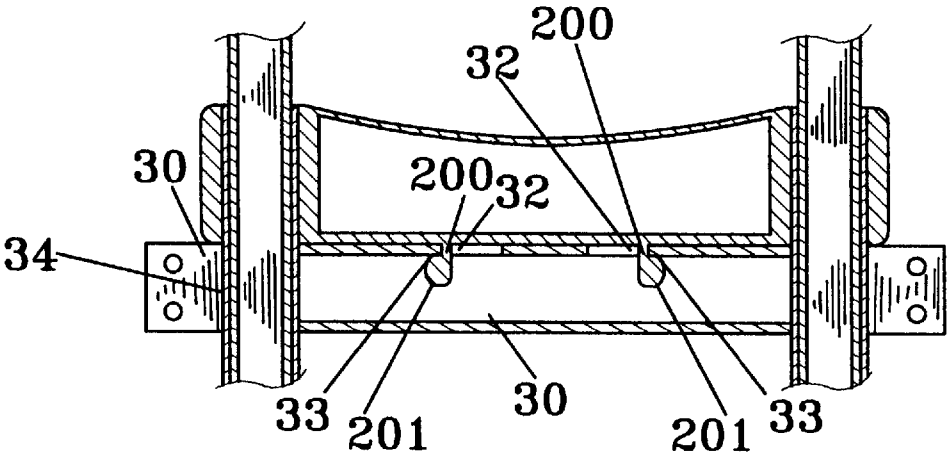
FIG. 6 is a partial cross sectional view illustrating an upper portion of the tube assembly in FIG. 5.
Figure 7:
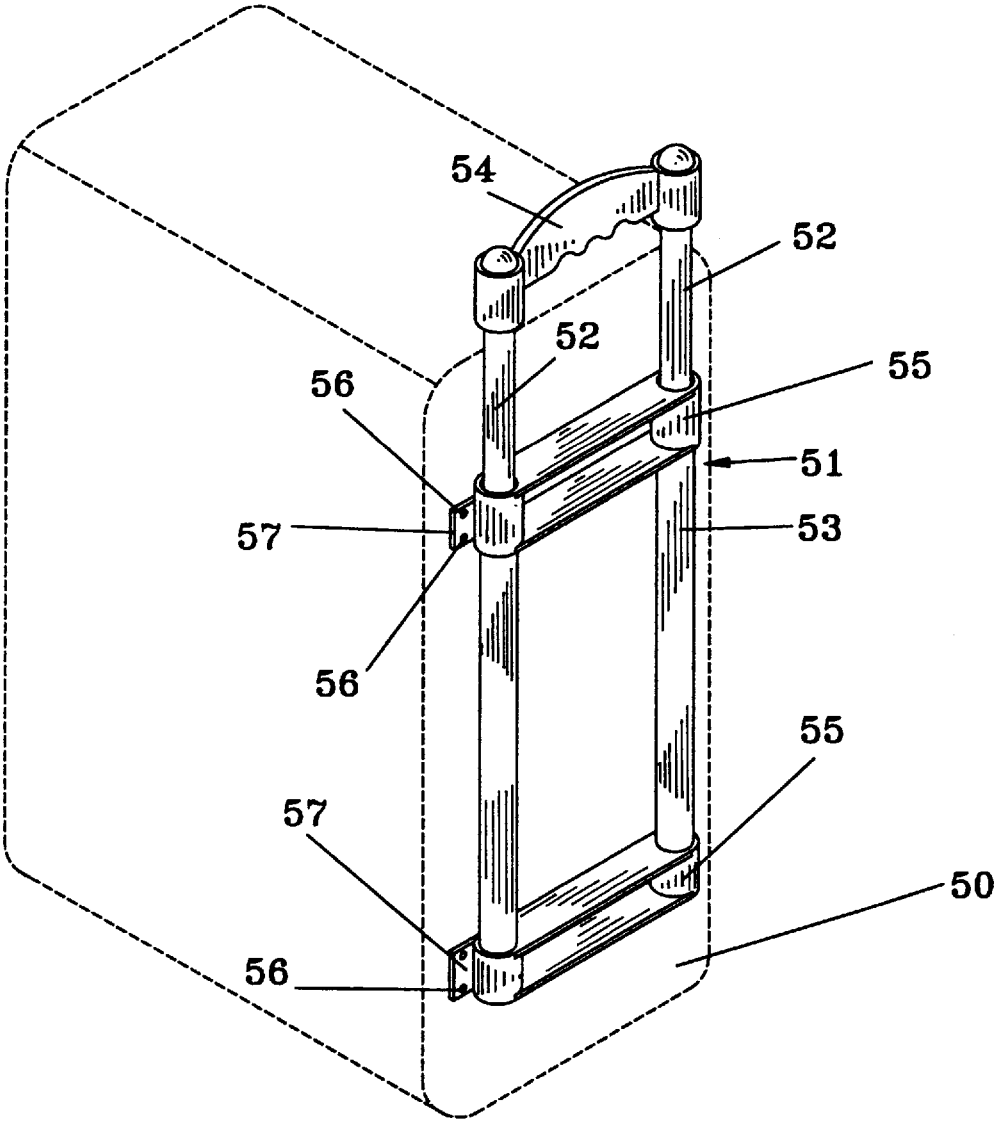
FIG. 7 PRIOR ART
FIG. 7 is a perspective view illustrating a conventional luggage trolley.

FIGS. 5 and 6 illustrates a modified embodiment of the slot means of the upper mounting seat 30 in which the block 31 in FIG. 1 is omitted and the mounting seat 30 is hollow and includes two slots 32 defined in an upper side thereof through which the snapping fasteners 200 (which is shorter in this embodiment) extend. Operation of assembly and detachment of the inner tube/outer tube assembly 10 are similar to that of the first embodiment and therefore not redundantly described.

Although the invention has been explained in relation to its preferred embodiment, it is to be understood that many other possible modifications and variations can be made without departing from the spirit and scope of the invention as hereinafter claimed.

What is claimed is:

1. A tube assembly for a luggage trolley, comprising:

mounting seat means fixedly mounted to a piece of luggage, said mounting seat means including an upper mounting seat fixedly mounted to an upper portion of the piece of luggage and a lower mounting seat fixedly mounted to a lower portion of the piece of luggage, said upper mounting seat having two first holes formed therethrough and said lower mounting seat having two second holes formed therein;

an inner tube/outer tube assembly detachably mounted to said mounting seat means, said inner tube/outer tube assembly including (a) a pair of outer tubes having respective upper and lower ends, (b) a pair of inner tubes having respective upper and lower ends, said lower ends of said pair of inner tubes being respectively telescopically received in said outer tubes, (c) a positioning seat coupled to said upper ends of said pair of outer tubes, said lower ends of said outer tubes passing through a respective one of said two first holes of said upper mounting seat and inserted into a respective one of said two second holes of said lower mounting seat, (d) means for releasably coupling said positioning seat to said upper mounting seat, and (e) a handle mounted to said upper ends of said inner tubes.

2. The tube assembly according to claim 1, wherein said releasable coupling means of said positioning seat includes snapping fastener means extending downwardly therefrom, said upper mounting seat including slot means defined therein for releasable engagement with said snapping fastener means.

3. The tube assembly according to claim 2, wherein the slot means includes a block provided on the upper mounting seat and including an upper slot defined in an upper side thereof through which the snapping fastener means extends and a side slot defined in a lateral side thereof and communicated with the upper slot for releasably engaging with the snapping fastener means.

4. The tube assembly according to claim 2, wherein the upper mounting seat is hollow and the slot means includes a slot defined in an upper side of the upper mounting seat through which the snapping fastener means extends.

5. The tube assembly according to claim 1, wherein said lower end of each said outer tube includes a first transverse hole defined in a periphery thereof, and a periphery defining each said second hole of the lower mounting seat includes a second transverse hole defined therein, and further includes an elastic means mounted in said lower end of each said outer tube and including a protrusion extended through the first through hole and releasably received in the second transverse hole.

* * * * *